US009877524B1

(12) United States Patent
Kaviani

(10) Patent No.: US 9,877,524 B1
(45) Date of Patent: Jan. 30, 2018

(54) AIR-CUSHIONED SHORTS FOR CYCLING

(71) Applicant: Ray Kaviani, Woodland Hills, CA (US)

(72) Inventor: Ray Kaviani, Woodland Hills, CA (US)

( * ) Notice: Subject to any disclaimer, the term of this patent is extended or adjusted under 35 U.S.C. 154(b) by 18 days.

(21) Appl. No.: 14/703,636

(22) Filed: May 4, 2015

Related U.S. Application Data

(63) Continuation-in-part of application No. 13/789,456, filed on Mar. 7, 2013, now Pat. No. 9,021,618.

(51) Int. Cl.
*A41D 1/08* (2006.01)

(52) U.S. Cl.
CPC ..... *A41D 1/084* (2013.01)

(58) Field of Classification Search
CPC ..... A41D 1/084; A41D 2600/104; A41D 13/0537
See application file for complete search history.

(56) References Cited

U.S. PATENT DOCUMENTS 612,552 A * 10/1898 Standeford ..... B62J 1/26 297/200
633,142 A * 9/1899 Monahon ..... B62J 1/26 297/200
1,468,072 A * 9/1923 Ogle ..... A47C 7/021 128/889
2,446,006 A * 7/1948 Hendricks ..... A47C 7/021 2/22
3,665,517 A * 5/1972 Hyman ..... A41D 13/02 2/82
4,422,183 A * 12/1983 Landi ..... A41D 13/015 2/455
4,737,994 A * 4/1988 Galton ..... A41D 13/0155 2/465
4,805,243 A * 2/1989 Gibbens ..... A41D 1/084 2/228
4,945,571 A * 8/1990 Calvert ..... A41D 1/084 2/161.1
4,961,233 A * 10/1990 Black ..... A41D 1/084 2/228
4,969,216 A * 11/1990 Guelli ..... A41D 13/0537 2/400
4,991,230 A * 2/1991 Vacanti ..... A41D 13/015 128/846
5,086,514 A * 2/1992 Ross ..... A41D 13/0155 128/DIG. 20
5,103,505 A * 4/1992 Llorens ..... A41D 13/0537 2/228
5,168,576 A * 12/1992 Krent ..... A41D 13/0156 2/16

(Continued)

*Primary Examiner* — Danny Worrell
(74) *Attorney, Agent, or Firm* — Colin P. Abrahams

(57) ABSTRACT

A cushioning pad for use with cycling shorts comprises an upper pad layer and a lower pad layer fixed to the upper pad layer. An inflatable chamber is formed by and between the upper pad layer and the lower pad layer. The inflatable chamber comprises a first lateral channel which is nonlinear and which has a width which varies along its length, and a second lateral channel which is nonlinear and which has a width which varies along its length. A pump is provided for inflating the chamber with air, and a release valve is provided for releasing air from the chamber.

13 Claims, 6 Drawing Sheets

(56) References Cited

U.S. PATENT DOCUMENTS 5,210,877 A * 5/1993 Newman ..... A41D 1/067 2/115
5,257,418 A * 11/1993 Jaskiewicz ..... A41D 19/01523 2/161.1
5,271,101 A * 12/1993 Speth ..... A41D 1/084 2/214
5,275,315 A * 1/1994 Carmack ..... A45F 3/00 2/94
5,282,277 A * 2/1994 Onozawa ..... A41D 13/00 2/108
5,330,249 A * 7/1994 Weber ..... A41D 19/01523 2/161.1
5,335,382 A * 8/1994 Huang ..... A43B 13/203 297/199
5,419,612 A * 5/1995 Rassekhi ..... B62J 1/26 297/200
5,500,952 A * 3/1996 Keyes ..... A41D 13/018 2/465
5,551,082 A * 9/1996 Stewart ..... A41D 1/08 2/227
5,689,836 A * 11/1997 Fee ..... A41D 13/015 2/22
5,833,515 A * 11/1998 Shahbazian ..... A41C 3/105 2/267
5,918,309 A * 7/1999 Bachner, Jr. ..... A41D 31/0061 2/2.5
5,975,629 A * 11/1999 Lorbiecki ..... B60N 2/4415 137/625.46
6,029,281 A * 2/2000 Battley ..... A41D 1/084 2/400
6,070,273 A * 6/2000 Sgro ..... A41D 13/0153 2/231
6,079,056 A * 6/2000 Fogelberg ..... A41D 13/0153 2/267
6,327,715 B1 * 12/2001 Castiglione ..... A41D 1/082 2/227
6,345,396 B1 * 2/2002 Schuler ..... A41D 13/0568 2/465
6,393,618 B2 * 5/2002 Garneau ..... A41D 1/084 2/214
6,460,195 B2 * 10/2002 Wang ..... A41D 1/06 2/227
6,519,781 B1 * 2/2003 Berns ..... A41D 13/0153 2/267
6,565,702 B1 * 5/2003 Forsyth ..... A41D 1/084 156/308.4
6,928,665 B1 * 8/2005 Yates ..... A41D 1/084 2/455
6,990,693 B2 * 1/2006 Reschewitz ..... A41D 1/084 2/228
7,430,766 B2 * 10/2008 Coccia ..... A41D 1/084 2/228
7,448,676 B2 * 11/2008 Wyner ..... B62J 1/26 297/199
7,707,650 B2 * 5/2010 Sides ..... A41D 13/0537 2/69
7,707,659 B2 * 5/2010 Africa ..... A41D 1/084 2/228
7,739,754 B2 * 6/2010 Garneau ..... A41D 13/0537 2/215
7,757,311 B2 * 7/2010 Garneau ..... A41D 1/084 2/215
7,784,116 B2 * 8/2010 Gallo ..... A41D 31/0044 2/267
7,950,169 B2 * 5/2011 Holt ..... A43B 13/20 36/153
8,042,197 B2 * 10/2011 Maier ..... A41D 1/084 2/228
9,073,593 B1 * 7/2015 Kuhl ..... B62J 1/26
2006/0191052 A1 * 8/2006 Bulian ..... A41D 1/084 2/23
2007/0186328 A1 * 8/2007 Bulian ..... A41D 1/084 2/69

* cited by examiner

AIR-CUSHIONED SHORTS FOR CYCLING

CROSS-REFERENCE TO RELATED APPLICATIONS

This application is a continuation in part application of U.S. patent application Ser. No. 13/789,456 filed Mar. 7, 2013, now U.S. Pat. No. 9,021,618 issued on May 5, 2015, the contents of which are incorporated herein by reference in their entirety.

FIELD AND BACKGROUND OF THE INVENTION

The present invention relates to cycling. More particularly, this invention pertains to shorts that include air-cushioning for significantly reducing the discomfort and possible risks to the rider often posed by the relatively hard seat of a cycle.

While bicycle riding, or cycling, is almost-universally appreciated as a high quality source of fitness and health, it can pose health issues, especially for male cyclists. Although a generally low impact activity, the interface between rider and a racing-type seat can contribute to not-insubstantial physical harm.

A racing-style seat is designed to provide minimal impediment to the rider's ability to "pump" his legs for maximum speed and power when, for example, racing or climbing a hill. This dictates that it present a minimal profile in the horizontal plane to offer maximum clearance for the insides of the rider's legs. This is in contrast to other types of recreational cycles that provide a well-padded seat of generally-triangular design. Such seats are found on cycles designed for leisurely coasting and are quite suitable for sightseeing rather than racing or strenuous workouts.

The seat of a racing-type cycle is generally horizontally-elongated and aligned with the frame of the cycle. It is characterized by a transverse cross-section of inverted u-shape for maximum leg clearance as discussed above. The described shape allows the unfettered pumping of the cyclist's legs. In keeping with the objective of minimizing interference with the pumping of the rider's legs, the seat of a racing-type cycle is minimalist, formed of a cast metal frame with an overlying cover of leather or synthetic fabric. Minimal allowance is made for cushioning material of any kind.

While a seat of the type described in the preceding paragraph is advantageous for the aggressive rider who may often be standing throughout the majority of his workout, such design poses certain well-recognized risks. The seat of a racing-type cycle is only minimally-functional in terms of cushioning when one sits on it for extended periods of time. This is especially the case for male riders whose physiology is not particularly well suited for resting on a hard seat. Riding can cause the weight of the upper body of a male rider to press the rider's prostate and gonadal region down upon the hard seat, resulting in medically-recognized harm.

Current designs of cycling shorts for men include padding of, for example, foam rubber, synthetic fabric or fiber that extends from the rider's seat to cover the crotch region. While offering some comfort and protection, such shorts are not particularly suitable for use by casual riders over long distances as the padding is subject to compression and can become hard and ineffective as a cushion with extended use.

SUMMARY OF THE INVENTION

According to one aspect of the invention, there is provided a cushioning pad for use with cycling shorts, the cushioning pad comprising: an upper pad layer; a lower pad layer fixed to the upper pad layer; an inflatable chamber defined by and between the upper pad layer and the lower pad layer, the inflatable chamber comprising a first lateral channel which is nonlinear and which has a width which varies along its length, and a second lateral channel which is nonlinear and which has a width which varies along its length; a pump for inflating the chamber with air; and a release valve for releasing air from the chamber.

Preferably, the cushioning pad comprises: an enlarged seat area, the first and second lateral channels being arranged in a substantially circular concentric configuration within the enlarged seat area; a narrower crotch area, the first and second lateral channels being arranged in a generally linear configuration within the narrower crotch chamber; a pump and release valve section for accommodating the pump and release valve; and a connector section extending between the pump and release valve section and the narrower crotch area.

In one embodiment, the inflate conduit extends between the pump and the lateral channels in the narrower crotch area, and the deflate conduit extends between the lateral channels in the narrow crotch area and the release valve. A one-way valve may be formed in the inflate conduit.

Preferably, the pump comprises an air chamber connected to the inflatable chamber by means of an inflate conduit, the air chamber comprising a resilient elasticized pump dome. The pump dome may include a small aperture therein which is covered by a user when depressing the pump dome to inflate the chamber, and uncovered when the pump dome is released so that the air chamber cancel with air. Further, the release valve may connect to the inflatable chamber by means of a deflate conduit, the release valve being closed under normal operating conditions, and selectively opened by the user to reduce air pressure in or drain air from the inflatable chamber.

In one embodiment, the first and second lateral channels have a constricting projection at a transition between the enlarged seat area and narrower crotch area, the constricting projection limiting the flow rate of air in the first and second lateral channels between the enlarged seat area and narrower crotch area respectively. Preferably, the connector section is of sufficient length so that the pump and release valve can be located at a top area of the cycling shorts while the enlarged seat area and narrower crotch area are located so as to coincide with the uses seat area and crotch area respectively.

Preferably, the first and second lateral channels in the narrower crotch area each have a parallel spur channel formed therein. In one embodiment, the first and second lateral channels in the enlarged seat area each comprise an outer generally circular leg, a generally linear leg toward a center of the enlarged seat area, and intermediate leg adjacent the outer circular leg, and an end leg between the linear leg and the intermediate leg.

The cushioning pad may be formed between fabric layers of the cycling shorts.

According to another aspect of the invention, there is provided a method of forming a cushioning pad for use in cycling shorts, the method comprising: placing an upper pad layer over a lower pad layer which is fixed to the upper pad layer; forming an inflatable chamber between the upper pad layer and the lower pad layer, the inflatable chamber comprising a first lateral channel which is nonlinear and which has a width which varies along its length, and a second lateral channel which is nonlinear and which has a width which varies along its length; placing a pump in communication with the inflatable chamber for inflating the chamber with air; and providing a release valve for releasing air from the chamber.

The present invention addresses the preceding and other shortcomings of the prior art by providing cycling shorts of novel design. Such shorts include a first fabric portion for covering at least a first upper leg of a wearer and extending to the wearer's waist and a second fabric portion for covering at least a second upper leg of a wearer rider and extending to the wearer's waist.

The first and second portions converge to a seam defining an axis of symmetry of the shorts. A pad is affixed to the inner surface of the shorts. The pad comprises integral seat section and crotch sections. The pad is aligned with respect to the axis of symmetry of the shorts so that the crotch section overlies the wearer's crotch region. The pad includes an interior chamber for receiving and retaining pressurized air.

The preceding and other features of the invention will become further apparent from the detailed description that follows. Such description is accompanied by a set of drawing figures. Numerals of the drawings, corresponding to those of the written description, point to the features of the invention with like numerals referring to like features throughout both the written description and the drawings.

DETAILED DESCRIPTION OF THE INVENTION

Figure 1A:
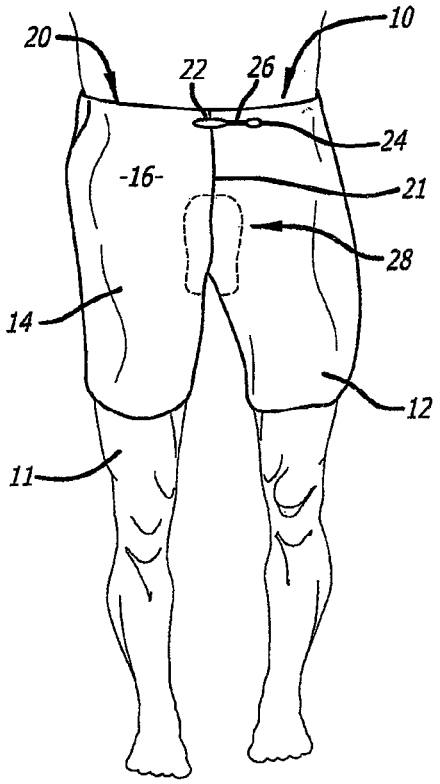
FIGS. 1A and 1B are perspective frontal and rear views of a pair of cycling shorts (on a wearer) in accordance with the invention.
Figure 1B:
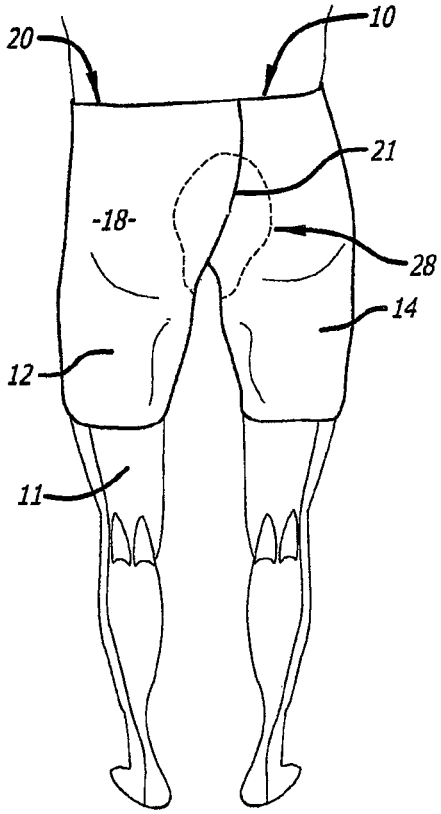

FIGS. 1A and 1B are perspective frontal and rear views, respectively, of cycling shorts 10 (on a wearer 11) in accordance with the invention. The shorts 10 of FIG. 1 are of the men's classic compression-fit design that generally comprises first and second (left and right) fabric portions 12 and 14 that cover portions of the legs of a wearer. The fabric portions 12, 14 upwardly converge, forming (at the front) a frontal portion or panel 16 and a seat portion or panel 18. The upper edge of the shorts 10 comprises a waistband 20. A seam 21 running between the portion of the waistband 20 adjacent the frontal panel 16 through that adjacent the seat panel 18 defines the axis of symmetry of the cycling shorts 10. As shown in FIGS. 1A and 1B, the seam 21 may represent an actual sewn seam that joins the two fabric portions 12 and 14. It may also be a "virtual" seam in the event that another physical seam configuration joins the fabric portions 12 and 14 to form the frontal and seat panels 16, 18. It shall be understood that, regardless of the configuration adopted for physical joinder of the fabric portions 12 and 14 to form the completed cycling shorts, the term seam is understood to be either a physical or virtual manifestation that coincides with the axis of symmetry of the cycling shorts 10 as is clearly the case as illustrated in FIGS. 1A and 1B.

The shorts of FIGS. 1A and 1B are preferably of elasticized synthetic fabric such as LYCRA™, and a waistband 20 may be reinforced with elastic material or a drawstring to secure the shorts 10 to the rider's waist.

The particular type of shorts illustrated in FIGS. 1A and 1B are, as mentioned earlier, of classic compression-fit design that terminate above a wearer's knees and offer a skin-tight fit that is especially suitable for racing. Numerous other designs of cycling shorts are recognized as more-or-less standard and, as will be seen, adaptable to the features that characterize the invention. Such alternative cycling short designs include so-called baggy and bib shorts.

Figure 3:
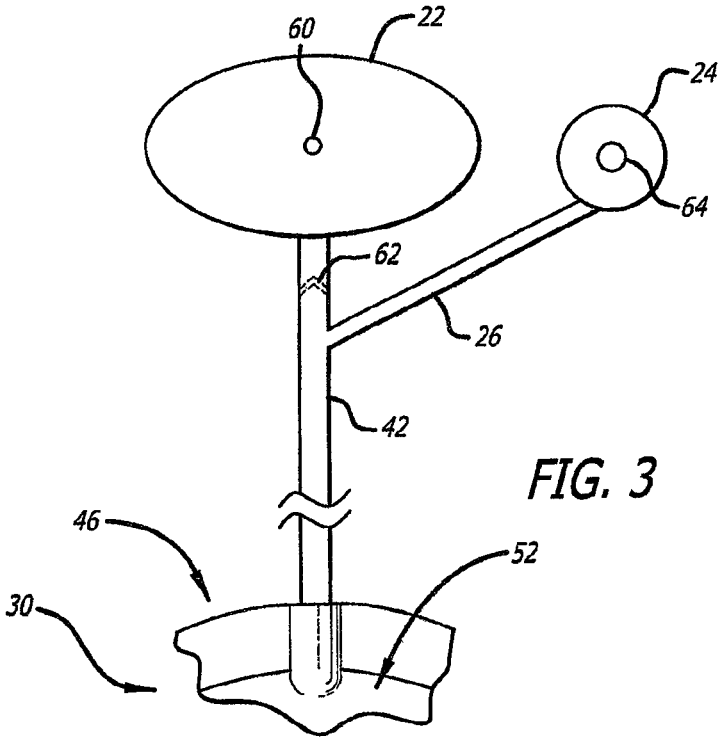
FIG. 3 is a schematic view of the air pump apparatus for cycling shorts in accordance with the invention.

As seen in FIGS. 1A, a pump 22 is centrally fixed to the upper frontal panel 16 in close proximity to the waistband 20. Offset from the pump 22 is a relief valve 24. The pump 22 communicates with the relief valve 24 through a connecting conduit segment 26. The overall arrangement of the system for selectively pumping air into the shorts 10 for air-cushioning is illustrated in FIG. 3 below.

Figure 2A:
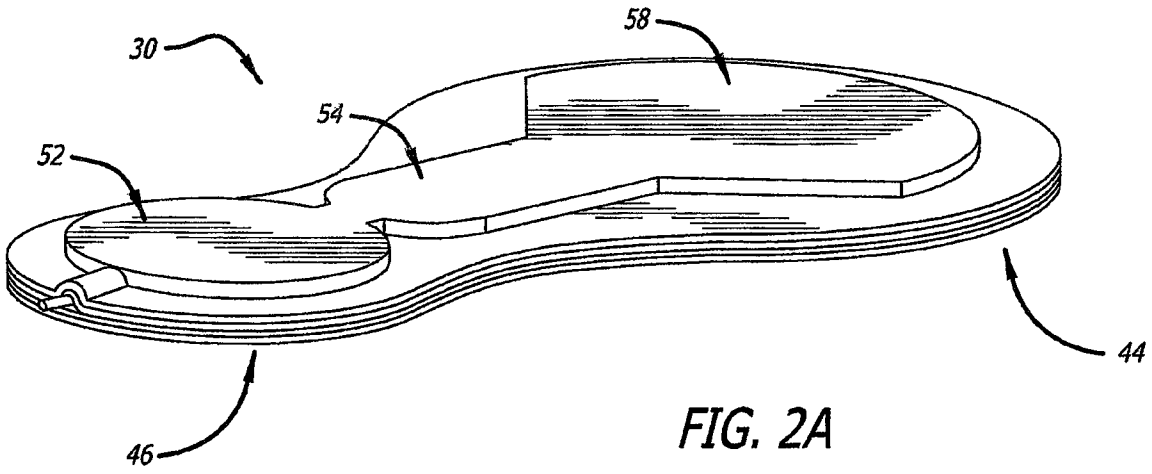
FIGS. 2A and 2B are perspective assembled and exploded perspective views, respectively, of the interior pad of cycling shorts in accordance with the invention.

A pad (not visible in FIG. 1A or 1B) is secured to the interior of the shorts 10 by stitching, indicated by a continuous stitch line 28 that spans both the frontal and seat panels 16 and respectively. Detailed views of the interior pad for air-cushioning of the shorts 10 are provided in FIGS. 2A and 2B, the view of FIG. 2A being a perspective view of an assembled interior pad 30 and that of FIG. 2B being an exploded perspective view of the pad 30 illustrating its internal details.

Figure 2B:
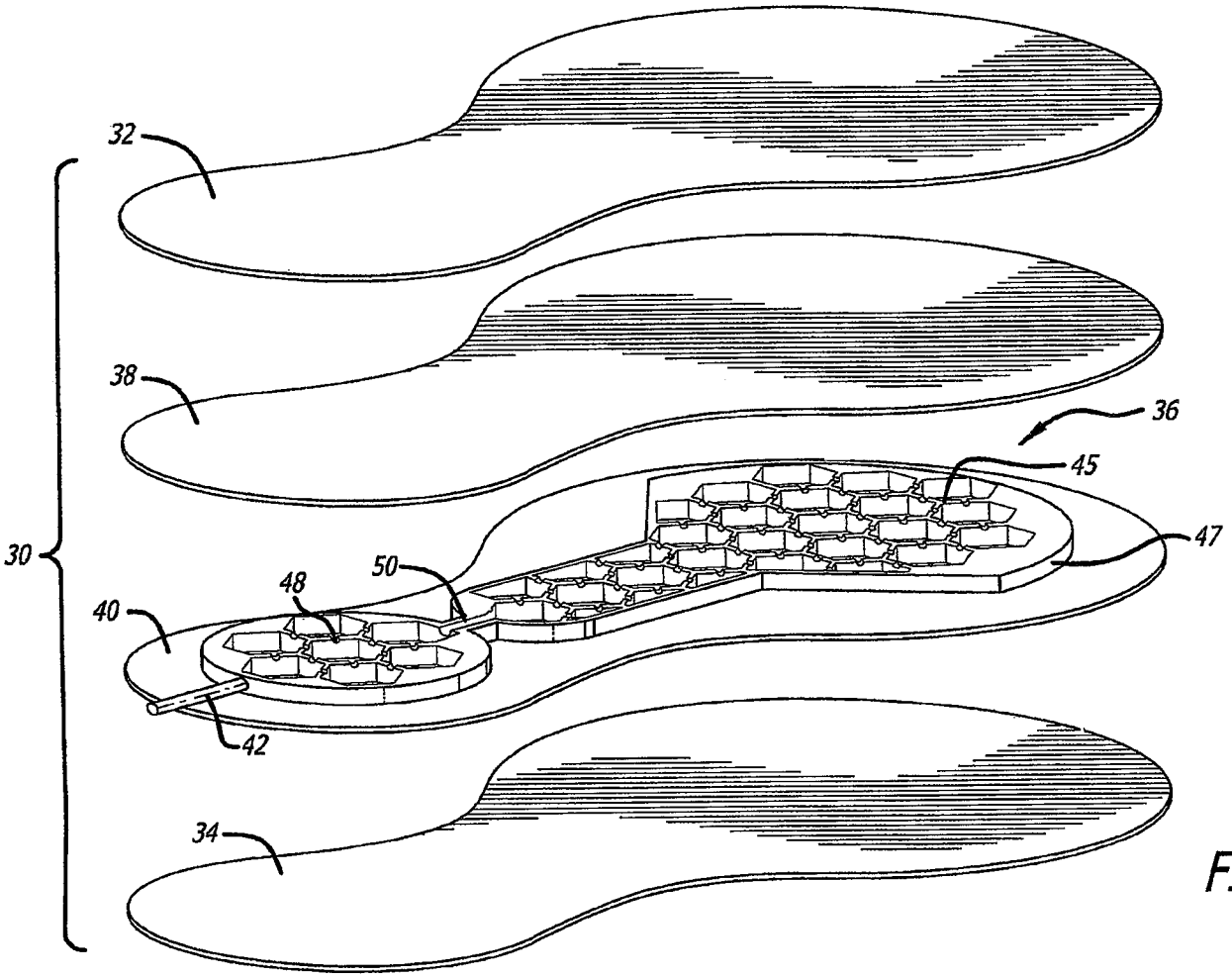

Referring in particular to FIG. 2B, the pad 30 comprises a composite, multi-layered device. Fabric outer layers 32, 34 surround an internal chamber 36 formed between mating internal layers 38, 40 of impermeable material. The internal layers 38, 40 are preferably formed of molded silicone rubber for flexibility and may be secured to one another by one or more of a number of conventional sealing processes such as gluing or fusion, thereby assuring that the internal chamber 36 formed between the internal layers 38, 40 is air tight. Designed apertures are provided within the internal chamber 36 for communication with an input/output air conduit 42 and for guiding the distribution of cushioning air within the internal chamber 36.

Returning to FIG. 2A, the assembled pad 30 is shaped to include relatively distinctly shaped enlarged seat and narrow crotch regions 44 and 46 respectively. When fixed to the shorts 10, the seat region 44 generally lies within the seat portion or panel 18 while the crotch region 46 extends from the seat portion to the frontal portion or panel 16.

Returning to the exploded perspective view of FIG. 2B, the internal chamber 36 is seen to be subdivided into a honeycombed plurality of cells, each cell being divided from the others by an arrangment of cell-defining internal walling 45 contained within a shaped outer wall 47. A variety of apertures and passages are provided within the internal chamber 36 to permit the controllable inflation of the pad 30 both prior to and during use. Recognizing that the first and second layers of impermeable material 38, 40 are sealed to one another when assembled, pressurized air can enter (and exit) the chamber 36 via the input/output conduit 42 through an accommodating aperture in the outer wall 47. Once within the boundary formed by the outer wall 47, such air can circulate under pressure within the internal chamber 36, guided throughout the cell-defining internal walling 45 via notches at upper edges of cells (such as a representative notch 48) and through a duct 50 that joins a front portion chamber 52 to a mid-portion chamber 54 of the internal chamber 36.

The chamber 36 is controllably pressurized by means of the manually-operable pump 22 that is fixed to the frontal panel 16 of the cycling shorts 10. Viewing FIGS. 2A and 2B together, it can be seen that the internal chamber 36 of the pad 30 is apportioned into a number of distinct sections to provide necessary protection and comfort for a wearer during cycling. Proceeding from front to rear, the front portion chamber 52 underlies and cushions the gonadal region of a wearer. It is connected by the internal duct 50 to the mid-portion chamber 54 that underlies the prostate area of a male cyclist. The relatively-narrow mid-portion chamber 54 merges with an enlarged seat region chamber 58 that underlies the rear or seat of the cyclist.

The honeycombed structure of the interior chamber 36 wherein cells permit limited transmission and redistribution of pressurized air between the various regions or sub-chambers described above assures that, once inflated, the interior chamber 36 will continue to support and cushion the various anatomical regions that can be negatively affected by pressure exerted by a hard racing-type seat on a rider. Were it not for the cellular structure with small ducts permitting only limited redistribution of air within the interior chamber 36 as the rider contacts the seat, air within the chamber 36 would invariably be disadvantageously distributed, largely negating any desired cushioning effect. Without the honeycombed internal structure of the chamber 36, air would be readily forced away from the regions underlying portions of the rider's anatomy that press hardest against the hard cycle seat toward those that exert lesser pressure. For example, one would expect lateral migration of pressurized air away from the centerline of joinder of the fabric portions 12, 14 of the shorts 10. This is both wasteful of the cushioning effect and degrades the effectiveness of the air cushion. Were one to attempt to compensate for this migration of cushioning effect, overinflation of the chamber 36 would undoubtedly produce other deleterious effects.

FIG. 3 is a schematic view of the air pump apparatus of the invention. Such apparatus enables the cyclist to inflate the pad 30 by an amount that provides comfort and protection. The apparatus includes the bladder-like pump 22, commonly known as a "palm pump" which includes a small aperture 60 for admitting air via suction when pressed. The input/output conduit 42 includes an internal trapping air valve 62 that limits air transfer, permitting air to flow solely from the bladder-like pump toward and/or into the pad 30. The relief valve 24 is connected to the input/output conduit 42 by means of the conduit 26. It includes a flap 64 that permits the rider to reduce pressure within the chamber 36 as desired. This prevents overinflation of the pad 30 that can be harmful in itself to the cyclist.

Impact testing using INSTRON DYNATUP™ instrumented impact test and data acquisitions software has shown that a pad in accordance with the invention as described, formed of laminated layers comprising an exterior of soft fabric and internal layers of impermeable material forming an internal chamber for receiving pressurized air, above can substantially reduce the loading in the presence of an applied force. Such load reduction is achieved by an increase in the degree of displacement (as compared with wood, as well as the padding employed in the following models of cycling shorts: for example, SUGOI™-XL, SUGOI™-L women and CANARI™)that is absorbed by an air-cushioned pad in accordance with the invention. Load reductions of 45 to 57 per cent were observed within a pad in accordance with the invention inflated in the range of 30 to 40 p.s.i. The other paddings (including wood) offered load reductions in the range of 0 to 27 per cent.

Reference is now made to FIGS. 4 to 7 of the drawings which illustrate a further embodiment of the invention. As seen in these figures, a pad 100 which may be used in combination with a pair of cycling shorts is provided. The pad 100 may be inserted in a pair of cycling shorts as illustrated and described in previous embodiments, or in any other way.

The pad 100 comprises a rear section 102, a mid section 104, a front section 106, an extender section 108, and an air control section 110. The rear 102, mid 104 and front 106 sections are intended to correspond to, and provide a cushion for, those parts of the body of the user, as already described above. The pad 100 incorporates chambers and channels, as will be described, which can be selectively inflated and deflated by the user so as to provide a comfortable and the desired cushioning effect.

The pad 100 is generally comprised of a first pad layer 112 and a second pad layer 114 of generally corresponding shape and configuration which are fused or otherwise connected to each other over certain areas, thereby creating the chambers and channels which are capable of being inflated and deflated only by operating an inflation pump 118 and release valve 120 which are formed on the air control section 110 of the pad 100. The edges and other portions of the first pad layer 112 and second pad layer 114 are fused to form an outer wall 130 at the edge of the pad 100, a center wall 132, and chamber defining walls 134. The extender section 108 and air control section 110 are also fused, in a way which defines an inflation conduit 140 and a deflate conduit 142.

A chamber 150 is formed within the pad 100, and the outer wall 130, center wall 132, and chamber walls 134 define generally mirror image channels 152 and 154 on each side of the central wall 132. Inwardly extending projections 156 along the length of the channels 152 and 154 control and minimize the flow of air through these channels. Circular walls 158 are provided within the channels 152 and 154.

The inflation conduit 140 extends between the pump 118 and the chamber 150. The conduit 140 includes a one-way valve 160 along its length which allows flow of air from the pump 118 to the chamber 150, but not the reverse. The deflate conduit 152 extends between the release valve 120 and the chamber 150, and the operation of the release valve 120 allows the user to selectively release air from the chamber 150.

The pad 100 of the invention is used in association with cycling or other shorts, as already described. The chamber 150 can be inflated with air to provide a comfortable cushioning customized for the user using the pump 118 and release valve 120. The chamber 150 is inflated by repeatedly depressing the pump 118, with the thumb over the hole 166. With each depression of the pump 118, air flows through the inflation conduit 140 and into the chamber 150. Between each pump action, the hole 166 is preferably exposed by lifting the thumb or finger, to expedite air intake into the pump. Air cannot flow out through the pump 118 since it will be stopped by the presence of the one-way valve 160. The air in the chamber 150 can be discharged or partially discharged by operating the release valve 120. The air in the chamber 150 will be partially discharged by operation of the valve 120 if the user finds the cushioning effect too hard, so as to create a more comfortable ride. The air in the chamber 150 will be fully discharged using the valve 120 when the cycling shorts are not in use, and for storage.

Figure 4:
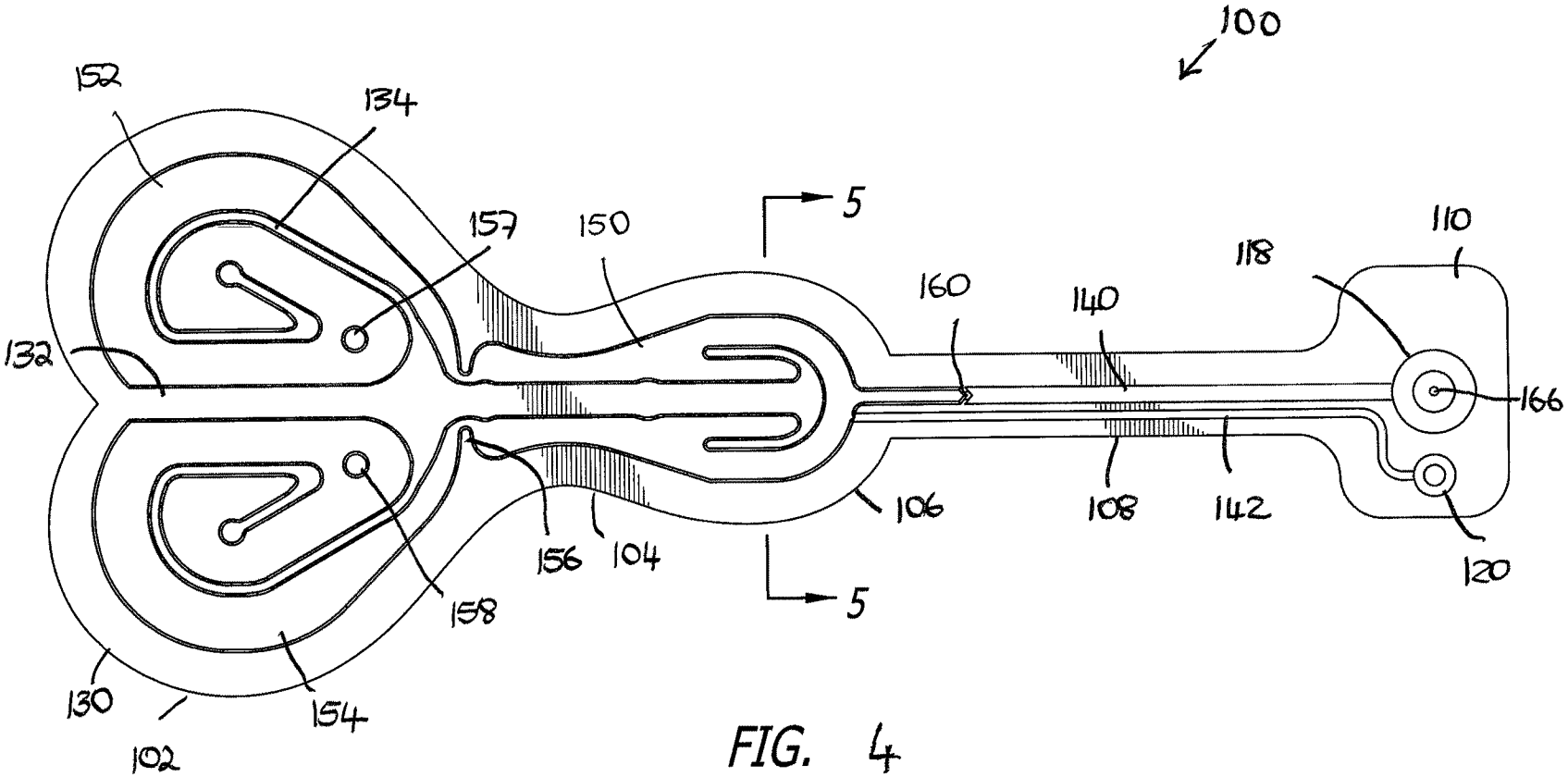
FIG. 4 is a top view of a pad which may be used in cycling shorts in accordance with a further aspect of the present invention.
Figure 5:
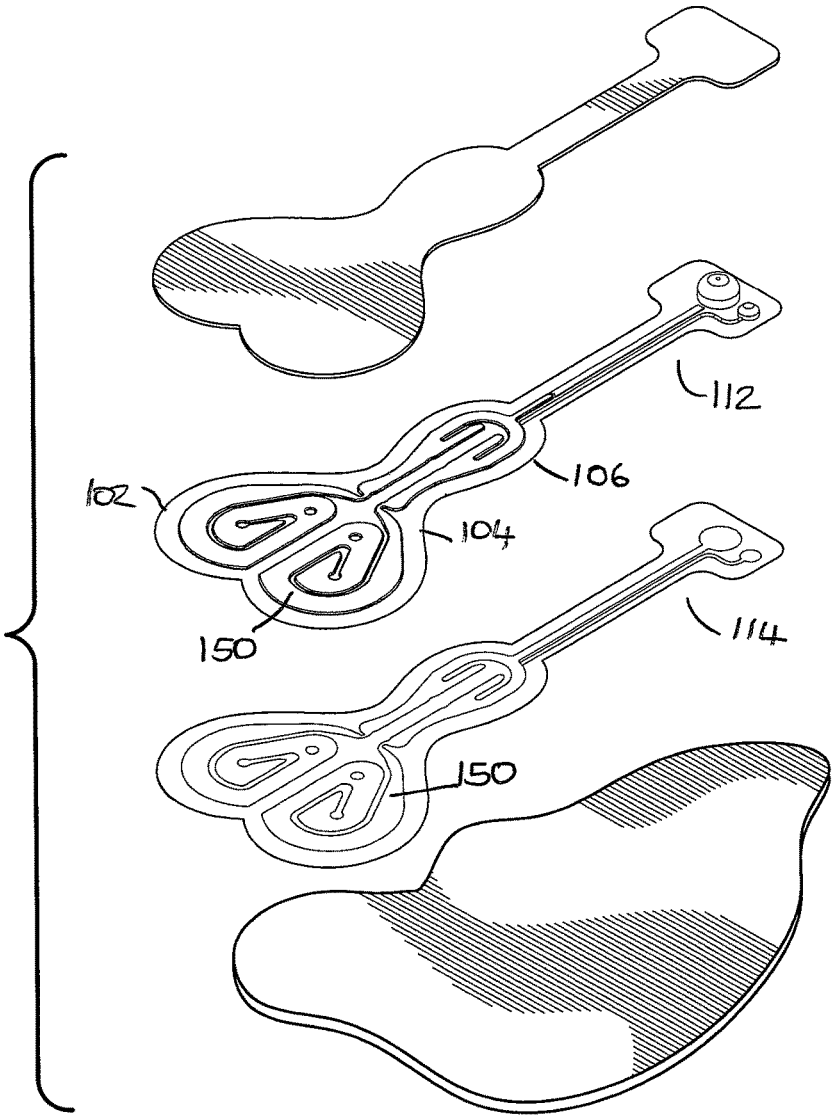
FIG. 5 is an exploded view of a pad which may be used in cycling shorts in one embodiment of the invention.
Figure 6:
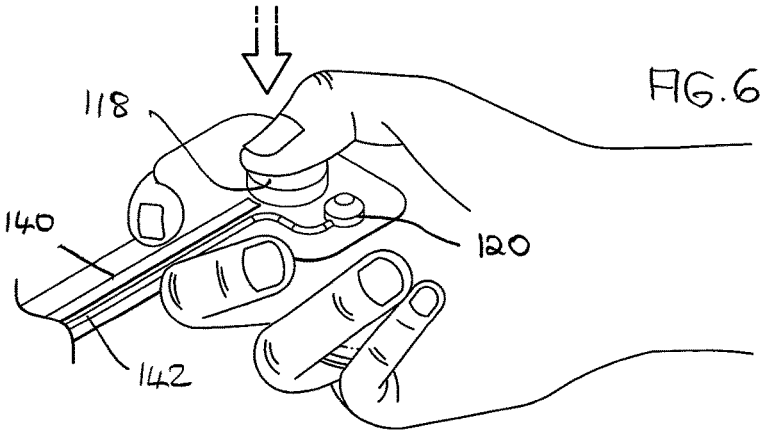
FIG. 6 is a detailed view showing the structure and operation of inflate and deflate valves for use with a pad which may be used in cycling shorts.
Figure 7A:
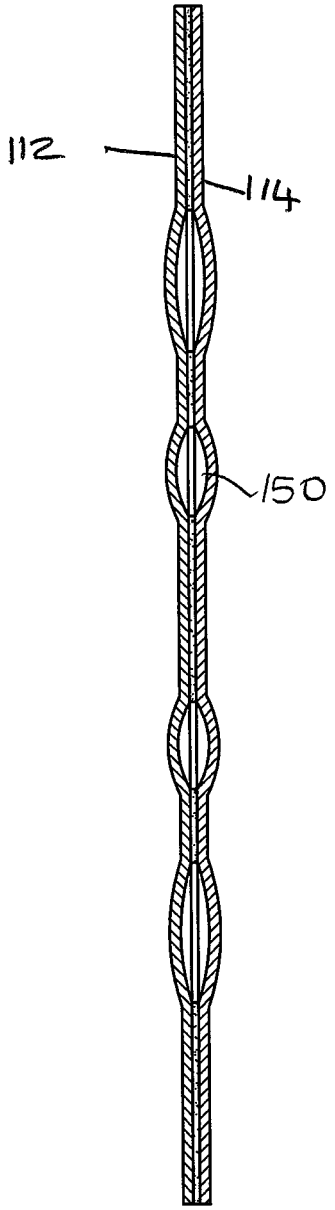
FIGS. 7A and 7B are detailed cross-sections of a portion of the pad for use in cycling shorts showing chambers when in the deflated or partially deflated condition and substantially inflated condition respectively.
Figure 7B:
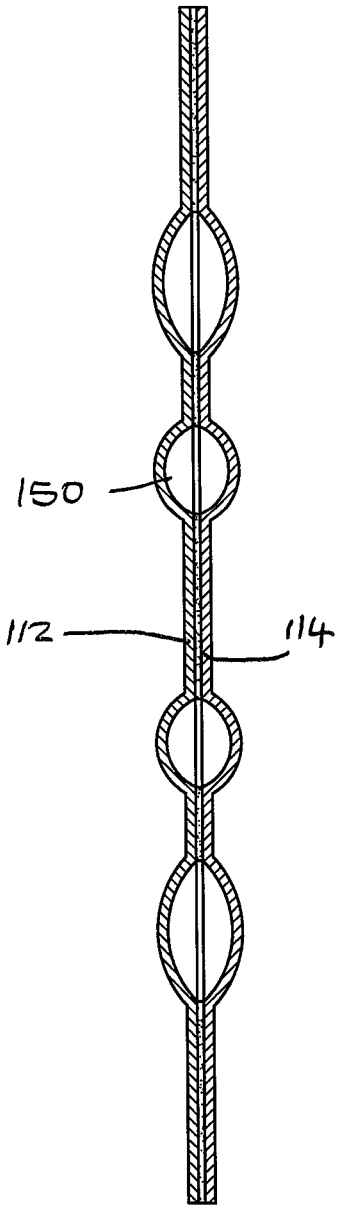

In FIGS. 7A and 7B, there is shown a detailed cross-section through the pad 100 along line 5-5 of FIG. 4 of the drawings. FIG. 7A shows the chamber 150 and channels 152 in a generally uninflated or partially inflated condition. FIG. 7B shows the chamber 150 and channels 152 when in the inflated condition, providing a cushion for the user.

Thus it is seen that the air-cushioned cycling shorts of the invention provide a means for protecting a rider from the potentially damaging effects of a racing-type seat. By utilizing the teachings of this invention, the cyclist may enjoy the manifold health benefits of cycling without substantial fear of harmful side effects.

While the invention has been described with reference to its presently preferred embodiment, it is not limited thereto. Rather, this invention is limited only insofar as it is defined by the following set of patent claims and includes within its scope all equivalents thereof.

The invention claimed is:

1. An air cushioned cycling shorts assembly comprising:
cycling shorts including a seat portion;
a cushioning pad formed in or on the cycling shorts at at least a part of the seat portion, the cushioning pad comprising:
an upper pad layer;
a lower pad layer fixed to the upper pad layer;
an inflatable chamber defined by and between the upper pad layer and the lower pad layer, the inflatable chamber comprising a first lateral channel having a front channel portion and a rear channel portion and which is at least partially nonlinear and which has a width which varies along its length, and a second lateral channel having a front channel portion and a rear channel portion and which is at least partially nonlinear and which has a width which varies along its length, the first lateral channel and the second lateral channel being discrete and separate from each other;
a constriction in each of the first and second lateral channels formed between the respective front channel portion and rear channel portion, the constriction comprising a partial barrier in the first and second lateral channels to substantially reduce the rate of air flow between the front channel portion and rear channel portion in the first and second lateral channels respectively;
a pump for inflating the chamber with air; and
a release valve for releasing air from the chamber.

2. An air cushioned cycling shorts assembly comprising:
an enlarged seat area, the rear channel portion of the first and second lateral channels being arranged in a substantially circular concentric configuration within the enlarged seat area;
a narrower crotch area, front channel portion of the first and second lateral channels being arranged in a generally linear configuration within the narrower crotch chamber;
the constriction in each of the first and second lateral channels being located at the transition between the enlarged seat area and the narrower crotch area;
a pump and release valve section for accommodating the pump and release valve; and
a connector section extending between the pump and release valve section and the narrower crotch area.

3. An air cushioned cycling shorts assembly as claimed in claim 2 further comprising an inflate conduit extending between the pump and the lateral channels in the narrower crotch area, and a separate and dedicated deflate conduit extending between the lateral channels in the narrow crotch area and the release valve.

4. An air cushioned cycling shorts assembly as claimed in claim 3 further comprising a one-way valve formed in the inflate conduit.

5. An air cushioned cycling shorts assembly as claimed in claim 1 wherein the pump comprises an air chamber connected to the inflatable chamber by means of an inflate conduit, the air chamber comprising a resilient elasticized pump dome.

6. An air cushioned cycling shorts assembly pad as claimed in claim 5 wherein the pump dome includes a small aperture therein which is covered by a user when depressing the pump dome to inflate the chamber, and uncovered when the pump dome is released so that the air chamber can fill with air.

7. An air cushioned cycling shorts assembly as claimed in claim 1 wherein the release valve connects to the inflatable chamber by means of a separate and dedicated deflate conduit, the release valve being closed under normal operating conditions, and selectively opened by the user to reduce air pressure in or drain air from the inflatable chamber.

8. An air cushioned cycling shorts assembly as claimed in claim 2 wherein the connector section is of sufficient length so that the pump and release valve can be located at a top area of the cycling shorts while the enlarged seat area and narrower crotch area are located so as to coincide with the uses seat area and crotch area respectively.

9. An air cushioned cycling shorts assembly as claimed in claim 2 wherein the first and second lateral channels in the narrower crotch area each have a parallel spur channel formed therein.

10. An air cushioned cycling shorts assembly as claimed in claim 2 wherein the first and second lateral channels in the enlarged seat area each comprise an outer generally circular leg, a generally linear leg toward a center of the enlarged seat area, and intermediate leg adjacent the outer circular leg, and an end leg between the linear leg and the intermediate leg.

11. An air cushioned cycling shorts assembly as claimed in claim 10 further comprising a column in the first and second lateral channels, the column being formed in a transition area between the linear leg and the intermediate leg.

12. An air cushioned cycling shorts assembly as claimed in claim 1 wherein the cushioning pad is at least partially covered with fabric layers over the upper pad layer and the lower pad layer respectively.

13. A method of forming a cushioning pad in cycling shorts, the method comprising:
placing an upper pad layer over a lower pad layer which is fixed to the upper pad layer;
forming an inflatable chamber between the upper pad layer and the lower pad layer, the inflatable chamber comprising a first lateral channel having a front channel portion and a rear channel portion and which is at least partially nonlinear and which has a width which varies along its length, and a second lateral channel having a front channel portion and a rear channel portion and which is at least partially nonlinear and which has a width which varies along its length, the first lateral channel and the second lateral channel being discrete and separate from each other;

forming a constriction between the front channel portion and the rear channel portion in each of the first and second lateral channels to provide a partial barrier there in for substantially reducing the rate of air flow between the front channel portion and the rear channel portion in the first and second lateral channels;

placing a pump in communication with the inflatable chamber for inflating the chamber with air; and providing a release valve for releasing air from the chamber.

* * * * *